United States Patent [19]

Dillon

[11] 4,343,302

[45] Aug. 10, 1982

[54] PROMOTING CIRCULATION OF BLOOD

[76] Inventor: Richard S. Dillon, 150 Mill Creek Rd., Ardmore, Pa. 19003

[21] Appl. No.: 233,073

[22] Filed: Feb. 9, 1981

Related U.S. Application Data

[63] Continuation of Ser. No. 955,620, Oct. 30, 1978, Pat. No. 4,269,175, which is a continuation-in-part of Ser. No. 803,656, Jun. 6, 1977, abandoned.

[51] Int. Cl.[3] ..... A61H 1/00

[52] U.S. Cl. ..... 128/24 R

[58] Field of Search ..... 128/24 R, 24, 40, 64, 128/30, 44, 38, DIG. 20, 24.2, 60, 298, 299

[56] References Cited

U.S. PATENT DOCUMENTS 3,961,625 6/1976 Dillon ..... 128/40

4,215,679 8/1980 Rustin ..... 128/40

*Primary Examiner*—Richard C. Pinkham

*Assistant Examiner*—T. Brown

*Attorney, Agent, or Firm*—Donald R. Johnson

[57] ABSTRACT

Circulation of blood to a patient's leg and return of blood from the leg to the heart are enhanced by supplying intermittent external pressure pulses to the leg, timed so that the pressure pulse follows close upon the arrival of the arterial pulse at the upper end of the leg, and reinforces the action of the arterial pulse in forcing blood into the leg. Between the external pressure pulses, the external pressure is relieved or diminished so that the succeeding arterial pulse may enter the leg without undue obstruction resulting from external pressure. The external pressure pulse is applied by forcing compressed gas into an inflatable enclosure surrounding the leg, and air may be introduced between the inflatable enclosure and the leg to prevent overheating of the leg. Means for admitting compressed gas to the enclosure are provided which are normally in the state such that the leg is not compressed, and which operate to compress the leg only when actuated by a signal generated from the patient's heartbeat. Adjustable means, e.g. movable walls, may be provided within the rigid enclosure to provide for each patient the optimum amount of free space into which the inflatable enclosure can expand, in spite of variations in the size of the leg from patient to patient.

1 Claim, 3 Drawing Figures

PROMOTING CIRCULATION OF BLOOD

CROSS REFERENCE TO RELATED APPLICATION

This application is a continuation of application Ser. No. 955,620 filed Oct. 30, 1978 (U.S. Pat. No. 4,269,175), which was a continuation-in-part of application Ser. No. 803,656 filed June 6, 1977 (abandoned).

BACKGROUND OF THE INVENTION

In U.S. Pat. No. 3,961,625 issued June 8, 1976, to the present inventor, method and apparatus were disclosed and claimed whereby a treatment is provided which provides pressure pulses to a patient's leg at a time in the arterial pulse cycle to reinforce the pulse which forces blood into the leg, and which relieves the pressure at a time in the pulse cycle to enable the next pulse to enter the leg without undue obstruction. Such treatment simultaneously provides a reinforcement of the movement of blood into the leg, and provides an enhancement of the return of blood from the leg to the heart, thereby increasing the overall circulation through the leg.

In the treatment, intermittent external pressure pulses are supplied to the leg, and timed in such fashion that the pressure pulse follows close upon the arrival of the arterial pulse at the upper end of the leg being treated, and reinforces the action of the arterial pulse in forcing blood into the leg. Between the external pressure pulses, the external pressure is removed or diminished, so that upon a succeeding arterial pulse, there is little or no external pressure on the leg, and the succeeding arterial pulse may enter the leg without undue obstruction resulting from external pressure.

The pressure pulses are supplied to the entire leg, so that the pressure acts not only in a portion of the arterial system of the leg, but to enhance the flow of blood in the entire arterial system, and to aid venous return from the leg to the heart. The pressure acts over a large portion of the affected area, enhancing the flow of blood from the area toward the heart and improving the circulation in the leg over that obtained by applying external pressure only in a relatively narrow band as in the prior art.

The application of the pressure is typically set at a predetermined variable interval after the QRS complex of the electrocardiogram, and the relief of the pressure is either set at a predetermined variable interval after application of the pressure or triggered by the QRS complex itself. The pressure is relieved at the time that the heart pulse arrives at the leg, so that the pulse enters the leg without interference from external pressure. The pressure is reapplied at a subsequent time at which the pulse has substantially entirely entered the leg, so that no interference with entry of the pulse into the leg results, and the effect of the pressure is to promote movement of blood through the leg, improving the circulation.

The application of pressure is preferably gradual, as compressed gas is re-introduced into the enclosure and the pressure in the enclosure gradually increases from approximately atmospheric to, typically 1 to 2 psig. The relief of pressure is sudden, by opening a valve from the enclosure to the atmosphere. The optimum timing of the application of pressure depends on the pulse rate and on the amount of free space in the enclosure surrounding the leg. For a pulse rate of 80 (0.75 second per beat), with a relatively small amount of free space in the enclosure, so that the pressure is applied rather quickly, the pressure might typically be applied about 0.45 seconds after the QRS complex of the cardiogram and continued for 0.3 second until the next QRS complex, at which time the pressure is relieved. For a pulse rate of 40 (1.5 seconds per beat), again with relatively little free space, the pressure might typically be applied about 0.8 seconds after the QRS complex and again continued for 0.7 seconds until the next QRS complex.

SUMMARY OF THE INVENTION

The present invention provides certain advantages and novel features over the method and apparatus disclosed in the prior U.S. Pat. No. 3,961,625.

One such advantage resides in the provision within the rigid enclosure of an inflatable, e.g. plastic, enclosure into which air is introduced to provide pressure upon the leg. Use of such enclosure provides advantages in preventing infection of the patient from the permanent rigid enclosure or contamination of the rigid enclosure from the patient, and in providing an extra seal to prevent escape of air from the rigid enclosure through any leaks the latter may have.

To apply the treatment to a patient's leg, the leg is placed within an inflatable enclosure and then placed in the lower portion of the rigid enclosure, the hinged top of which is open. The inflatable enclosure contains an elastic sealing connection into which the end of an air inlet connection to the rigid enclosure is connected. The top of the rigid enclosure is then closed, and the intermittent compression and decompression of the leg, by introduction of compressed air into, and removal of air from, the inflatable enclosure is begun. When the treatment is completed the leg and inflatable enclosure are removed from the rigid enclosure and the inflatable enclosure may be disposed of.

Inflation of the inflatable enclosure presses a wall of that enclosure against the patient's leg, potentially permitting the leg to overheat and perspire, which is undesirable for an ischemic leg. In one embodiment of the invention, a tube is provided between the wall of the inflatable enclosure and the leg, through which air is introduced into contact with the leg to provide venting and prevent overheating and perspiration.

The present invention provides an air outlet valve which is normally in the open position unless power is supplied to a solenoid to close the valve. In the event of a power failure for any reason, the valve opens and the leg is decompressed; this avoids compressing the leg for a long enough period to adversely affect the leg. Preferably, the air outlet valve is powered for only a pre-set fraction of a second so that the development of a slow heart rate will not prolong the compression part of the cycle but will prolong the decompression part of the cycle instead.

In one embodiment, the air inlet valve and the air outlet valve are both air-operated valves which are operated by means of a solenoid-operated pilot valve. A source of air is provided to the pilot valve, and when the pilot valve is opened by the solenoid, air flows through the pilot valve to operate the air inlet valve, opening it, and the air outlet valve, closing it, and also to provide a source of air flow through the air inlet valve into the plastic enclosure.

In one embodiment, the present invention provides means for adjusting the available space within the rigid enclosure for the receipt of the patient's leg. In this way, the free space, i.e. the amount of volume available for the plastic enclosure to be inflated into, can be adjusted to an optimum level for legs of different size. In general, the less the amount of free space, the more rapid is the compression and decompression of the leg upon admission of compressed air into, and removal of air from the inflatable enclosure, respectively. The amount of free space may be adjusted, for example, by means of inner walls which can be moved to different positions and temporarily fixed in a desired position by fastening means such as pegs, whereby the horizontal dimension of the free space is adjusted. Means for adjusting the vertical dimension of the free space can also be provided, e.g. by stiff, sheet-plastic flaps secured to the inner surfaces of the side walls of the rigid enclosure, which are flexible enough to be arced over the leg and the inflatable enclosure and fastened e.g. by buckles, to adjust the height above the leg into which the inflatable enclosure can expand. Other suitable means can be provided for adjusting the amount of free space.

DESCRIPTION OF THE FIGURES AND PREFERRED EMBODIMENT

Figure 1:
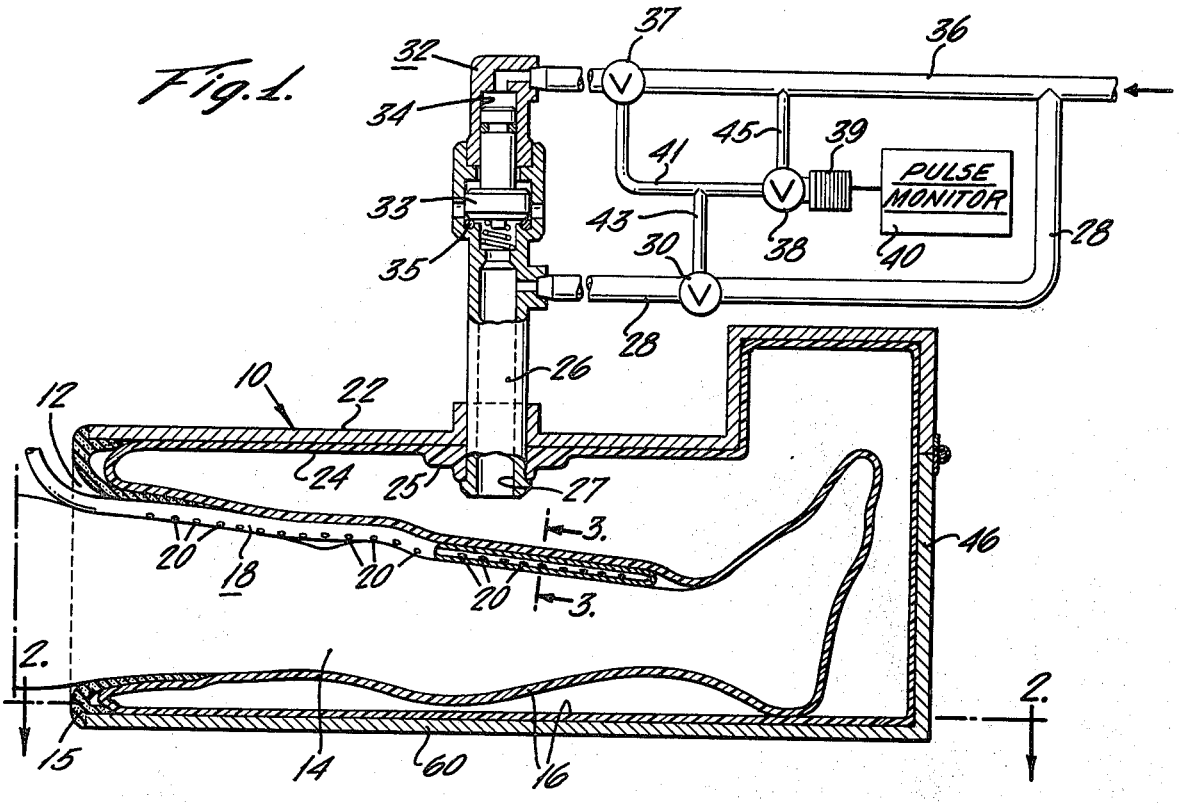
FIG. 1 is an elevation view partially in section of an enclosure for a patient's leg according to the invention.

In FIG. 1, a rigid enclosure 10 has an opening 12 for insertion of the leg 14. The top and upper sides of the enclosure 10 are preferably a separate section from the lower sides and bottom of the enclosure 10 and hinged thereto, for easy insertion of the leg by opening the top, inserting the leg and closing the top by closure means not shown. A rubber cuff 15 is secured to the open end of rigid enclosure 10 provides an opening for the leg which fits against the leg and provides a seal for the enclosure.

Surrounding the leg is an inflatable plastic enclosure 16, which is shown in the inflated position with the inner portion of the plastic enclosure against the leg and the outer part against the inside wall of the rigid enclosure. Secured to an upper part of the inner portion of the plastic enclosure is a tube 18 with the perforations 20 therein.

Passing through and fitting tightly within an aperture in upper wall 22 of rigid enclosure 10 and secured in an aperture 27 in an elastic sealing member 25 attached to the upper surface 24 of plastic enclosure 16 is the open end of an air inlet conduit 26. Communicating with conduit 26 is air supply conduit 28 in which is an air-operated valve 30. Air outlet valve 32 in air inlet conduit 26 comprises a cylindrical valve element 33 which is biased upwardly by a spring not shown. Element 33 is adapted for vertical movement in chamber 34 which is secured to conduit 26 by means not shown. As shown in FIG. 1, valve element 33 is in the closed position, seated against o-ring 35 by the force of compressed air introduced through line 36 into chamber 34. When valve 37 closes, the air pressure in chamber 34 is relieved by exhaust through valve 37, and the spring biases element 33 upwardly away from o-ring 35 to permit air to flow from line 26 through the circumferential area between the bottom of element 33 and O-ring 35. Pilot control valve 38 is operated by solenoid 39 which is operated by electrical pulses from pulse monitor 40, which is connected to electrocardiograph apparatus.

Figure 2:
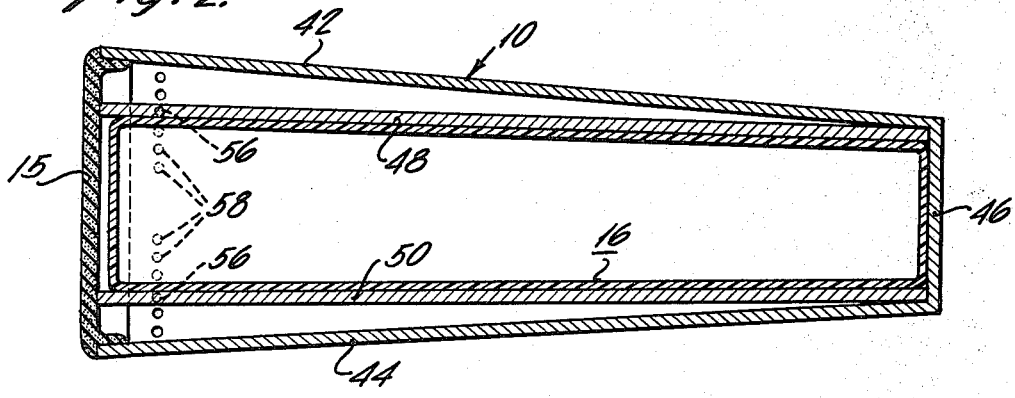
FIG. 2 is a sectional view of the enclosure on line 2—2 of FIG. 1.
Figure 3:
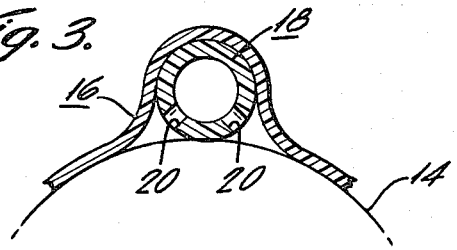
FIG. 3 is a sectional detail view on line 3—3 of FIG. 1.

Referring to FIG. 2, rigid enclosure 10 has outer walls 42 and 44 which are rigidly secured to end wall 46. Within enclosure 10 are movable rigid walls 48 and 50 which are secured in the desired position by means of pegs 56 which fit into chosen ones of a series of holes 58 in the bottom 60 of the rigid enclosure 10 and into recesses in the bottom of the walls 48 and 50. Similar pegs not shown can be used to fit into a series of corresponding holes in the tops of the rigid enclosure 10 and into corresponding recesses in the top of the walls 48 and 50.

Valves 30 and 37 are quick-acting air-operated valves of any known kind, which upon closing exhaust the downstream air pressure. Such valves are readily available. Valve 38 is a quick-acting solenoid-operated valve of any known kind, such valves also being readily available. Typically, the air pressure in lines 28 and 36 is 35 to 55 psig and in lines 37 and 39 0 to 2 psig. Conventional pressure regulators, not shown, are used in lines 28 and 45. Conventional mufflers, not shown are preferably employed in valves 30, 37 and 38 to provide quiet action of the valves.

In operation, the leg 14 is placed in the plastic enclosure 16 and the leg and plastic enclosure are placed inside the rigid enclosure 10. The lower end of air inlet 26 is secured within the aperture 27 in plastic enclosure 16. The plastic enclosure is initially in the uninflated condition with valves 30 and 38 closed as that air is not admitted to plastic enclosure 16, and with valve 37 closed and valve 32 open so that the interior of plastic enclosure 16 is open to the atmosphere.

Pulse monitor 40 senses the beginning of the QRS complex to the heartbeat following entry of blood into the leg impelled by the heartbeat, and generates an electrical pulse which operates solenoid 39, opening valve 38. Air passing through valve 38 and line 41 causes valve 37 to open and admit air into chamber 34, closing valve 32. Simultaneously, air passing through valve 38 and line 43 causes valve 30 to open and admit compressed air into air inlet 26. Air passing through inlet 26 inflates plastic enclosure 16 to the position shown in FIG. 1, thereby compressing the leg 14. Valve 32 being closed, the air is not permitted to escape to the atmosphere.

Current flows through solenoid 39 for a fraction of a second as a result of generation of the signal by pulse sensor 40. When the flow of current ceases, the solenoid returns to its initial position, thereby closing valve 38 and shutting off the flow of air to air-operated valves 30 and 37. Thereupon valve 30 closes so that entry of air into conduit 26 ceases, and valve 32 opens, releasing the air in plastic enclosure 16 to the atmosphere and relieving the pressure on the leg. Valve 32 is a quick-opening valve, so that release of air to the atmosphere occurs rapidly upon the elapsing of the predetermined time interval after the QRS complex.

Upon the venting of air from plastic enclosure 16, a supply of air is provided to tube 18 by means not shown, e.g. by connecting tube 18 to the exhaust of valve 30 or 37. When these valves close, a small amount of air is exhausted, which may be led into tube 18 and through aperture 20 into the space between the deflating plastic enclosure 16 and the leg 14, thereby cooling the leg and preventing overheating and perspiration that may otherwise occur as a result of the repeated compression and contact of the plastic enclosure 16 with the leg.

Alternatively, air may be supplied to the tube 18 from a source other than the air issuing from valve 30 or 37 upon relief of the pressure. Oxygen from a hospital wall outlet or an oxygen tank or other source may be used as an alternative source for the gas supplied to tube 18.

The tube 18 may be separate from the inflatable enclosure 16 (and taped for example to the patient's leg) or it may be sealed thereto. Alternatively the tube 18 may be formed integrally with the enclosure 16, as by heat sealing portion of the plastic of the enclosure 18 to form a tubular portion which is then perforated.

Overheating and perspiration occurs with some patients, but not others, and the use of the air-supply means such as the tube 18 is particularly advantageous with the former, but may be used to advantage in some other instances as well.

By providing a rigid enclosure in the apparatus of the invention, and limiting the amount of free space, an advantageous pumping action is provided in which the leg is more effectively decompressed in the decompression part of the cycle, than in an otherwise similar operation with no inflatable enclosure, but without the surrounding rigid enclosure.

The cycle of operation is typically as follows in the treatment according to the invention:

1. The QRS complex is detected by a monitor, signaling the initiation of the heartbeat.
2. An adjustable delay interval is provided, e.g. 0.4 second, to allow the pulse wave to travel from the heart to the leg. During this interval, no power is delivered to the valves. The air outlet valve is open during this interval, venting the pressured air from the plastic enclosure.
3. At the conclusion of the delay interval, power is delivered to the valves. The air outlet valve is closed and the air inlet valve is simultaneously opened, thus trapping air with the plastic enclosure. The power continues either until the next QRS complex is detected or for a present adjustable time interval (typically in the range from 0.3 to 0.7 second) less than the interval to the next QRS complex.

Although the provision of both a rigid enclosure and an inflatable enclosure therewithin is preferred for reasons stated previously, it is within the scope of the invention to use an inflatable enclosure as disclosed herein without the surrounding rigid enclosure or rigid movable walls, and with suitable means being provided for holding the inflatable enclosure in position around the patient's leg.

The invention claimed is:

1. Apparatus for improving circulation of blood through a leg which comprises: a rigid enclosure for a leg; a conduit communicating with an aperture in the upper wall of said enclosure and extending upwardly from said enclosure, said conduit having an outlet valve in an upper portion thereof, said outlet valve comprising a valve element normally biased upwardly to the open position to permit gas to flow through a circumferential area between the valve member and the valve seat; a compressed gas supply conduit communicating with the first-named conduit in a lower portion thereof; a normally closed inlet valve in said conduit; a source of compressed gas to said supply conduit and to said inlet valve and said outlet valve; means biasing said outlet valve to the open position; means responsive to heart action for supplying compressed gas from said source to said inlet valve to open said valve, and to said outlet valve to force said valve to the closed position in opposition to said biasing means, and for alternately interrupting said supply, thereby to close said inlet valve and to return said outlet valve to the open position.

* * * * *